US007990238B2

(12) United States Patent
Tan

(10) Patent No.: US 7,990,238 B2
(45) Date of Patent: Aug. 2, 2011

(54) BUTTON SYSTEM FOR INDUSTRIAL AC/DC RELAYS

(75) Inventor: Zhonghua Tan, Xiamen (CN)

(73) Assignee: Xiamen Hongfa Electroacoustic Co., Ltd., Xiamen (CN)

( * ) Notice: Subject to any disclaimer, the term of this patent is extended or adjusted under 35 U.S.C. 154(b) by 80 days.

(21) Appl. No.: 12/593,984

(22) PCT Filed: Jul. 3, 2008

(86) PCT No.: PCT/CN2008/071541

§ 371 (c)(1),
(2), (4) Date: Sep. 30, 2009

(87) PCT Pub. No.: WO2008/151580

PCT Pub. Date: Dec. 18, 2008

(65) Prior Publication Data

US 2010/0117770 A1 May 13, 2010

(30) Foreign Application Priority Data

Jun. 12, 2007 (CN) ..... 2007 1 0009098

(51) Int. Cl.
*H01H 51/22* (2006.01)

(52) U.S. Cl. ..... 335/78; 335/202

(58) Field of Classification Search ..... 335/78–86, 335/202

See application file for complete search history.

(56) References Cited

U.S. PATENT DOCUMENTS

| | | | | |
|---|---|---|---|---|
| 6,023,212 | A * | 2/2000 | Mader | 335/202 |
| 6,545,575 | B1 * | 4/2003 | Hirabayashi et al. | 335/78 |
| 6,924,719 | B2 | 8/2005 | Saruwatari et al. | |
| 6,933,815 | B2 | 8/2005 | Saruwatari et al. | |
| 6,949,997 | B2 | 9/2005 | Bergh et al. | |
| 7,161,104 | B2 | 1/2007 | Bergh et al. | |

FOREIGN PATENT DOCUMENTS

| | | | |
|---|---|---|---|
| CN | 1540698 | A | 10/2004 |
| CN | 1558436 | A | 12/2004 |
| CN | 101162665 | A | 4/2008 |
| JP | 10031948 | A | 2/1998 |

* cited by examiner

*Primary Examiner* — Ramon M Barrera
(74) *Attorney, Agent, or Firm* — Rabin & Berdo, P.C.

(57) ABSTRACT

A button system for industrial AC/DC relays comprising a casing (10), a button (5), a driving block (7), an indication board (8) and a core propelling block (6), wherein the cover board (1) and the housing (2) fixed with each other, and at least an opening (11) for pulling the button (5) is arranged on the cover board; the button (5) is pivoted on the top of the casing (10) by the transverse shaft (51); the driving block (7) mounted in the casing (10), the end of the driving block (7) abut against the toughing portion (53) of the button (5); the indicator board (8) is pivoted in the casing (10), the upper portion of the indicator board (8) abut against the front end of the strip driving arm (71) of the driving block (7), and the lower portion is match with the core propelling block (6).

14 Claims, 10 Drawing Sheets

BUTTON SYSTEM FOR INDUSTRIAL AC/DC RELAYS

FIELD OF THE INVENTION

The present invention relates to an industrial AC/DC relay, and more particularly, to a button system for industrial AC/DC (alternating current/direct current) relay.

BACKGROUND OF THE INVENTION

To facilitate the debugging of the electric function of the industrial equipment and machines, each of traditional industrial electromagnetic AC/DC relays has a button system which can change-over the contact of relay in the no-electrified status, the button system comprises a button and a casting, one end of the button usually configured to be a cylinder which can move repeated in a cylindrical hole of the casing, the top of the cylinder can drive the contact system of the relay to change-over the contact of the relay, thus achieve the object of switching load. The other end of the button usually configured to be a restoring arm with elasticity, when the button pressed, the plastic restoring arm would produce a deformation restoring force, when the button is released, the restoring arm will be repositioned by restoring force. FIG. 1 is a view of button system of button-type relay in prior art, the button system comprises a button 1', a casing 2', a movable contact pieces 3', one end of the button 1' is a driving cylinder 11' aligns with a guide hole 21' of the casing 2', and the other end is restoring arm 12', the front end of the driving cylinder 11' is near the protrusion 31' of the movable contact pieces 3', when the button is pressed, the driving cylinder 11' of the button move downwardly to urge the front end (i. e. the head) of the driving cylinder 11' downwardly and therefore to urge the protrusion 31' of the movable contact pieces 3', thus the movable contact pieces 3' rotated and the contact of the relay changed-over. When the button is released, the pressed force removed, then the driving cylinder 11' will return to the former position by the restoring arm 12', the movable contact pieces 3' return to former position also, the contact return to the cut-off status. The structure of this button system is quite simple, but its volume is too larger to be used in small-sized AC/DC relay.

SUMMARY OF THE INVENTION

The primary object of the present invention is to obviate the disadvantages of the prior art, and provide a button system for industrial AC/DC relay which can be used in more recent AC/DC electromagnetic relays without changing any installing area of the more recent AC/DC electromagnetic relays, this button system can be installed intensively to lower the cost of the machine tools and machines.

This object is achieved by providing: a button system for industrial AC/DC relays comprising:

A casing for containing the core of the relay, said casing comprising a cover board, a housing, the cover board and the housing fixed with each other, at least an opening for pulling the button is arranged on the cover board;

A button pivoted on the upper portion of the casing by a rotatable cross shaft, said button comprising a pulling portion which can be pull in the opening of the casing and a toughing portion which can be rotated in the opening according to the action of the pulling portion;

A driving block installed in the casing, the end of the driving block abut against the toughing portion of the button, the driving block comprising a strip driving arm which can be pulled to move forwardly by the rotation of the toughing portion of the button, and two U-shaped restoring arms incorporated on both sides of the end of the strip driving arm, the outer end of said restoring arms fixed to the casing;

An indicator board having rotatable cross shafts in the middle portion, said indicator board pivoted in the casing via said cross shafts, the upper portion of the indicator board abut against the front end of the strip driving arm of the driving block, and the lower portion cooperated with the core propelling block;

A core propelling block horizontally mounted in the casing and connected with the movable contact pieces of the core of the relay, a groove disposed on the top of the core propelling block, and the lower end of the indicator board matched in the groove of said core propelling block;

Said cover board having a hole, and the casing having a corresponding projection, the projection of the casing inserted in the hole of cover board, and the cover board fixed with the casing by clamping or hot rivet or gluing.

The edges of said cover board formed a flange, and the casing formed a recess in corresponding position, said flange of said cover board locked in the recess of said casing.

The pulling portion of said button is board shape, cylindrical projections projecting in opposed direction at the end on both sides of the board, cylindrical projections pivotally connected to the casing, the toughing portion of said button is a protrusion vertical to the board, the protrusion arranged in the middle of the end of the board structure.

Both sides of the opening of the cover board has a U-shaped groove respectively which opened downwardly, the two protrusion cylinders rotatably contained in the two U-shape grooves of the cover board, and the protrusion cylinders are limit and supported by the corresponding portion of said casing.

The inner side of said cover board having a guiding groove parallel to the board surface, the strip driving arm of the driving block slidably mounted in the guiding groove of said cover board.

The outer end of the U-shaped restoring arm of said driving block having a protrusion, and a recess for fixing the protrusion disposed the inner side of the cover board, the protrusion of the outer end of the U-shaped restoring arm inserted in the recess of said cover board;

A projection abut against the bottom of the protrusion of the U-shaped restoring arm is arranged in said housing in the position corresponding to the recess of said cover board for fixing the U-shaped restoring arm.

Said indicator board has a cross structure comprising a transverse shaft and a vertical shaft, both ends of the transverse shaft having a projection respectively, and the two corresponding wall of the casing having a U-shaped groove respectively; the two projection rotatably contained in the two U-shaped grooves of the housing and are limit by the corresponding portion of the cover board.

The upper end of the vertical shaft of said indicator board has a indication portion for indicating the motion of the relay, and a indication window disposed on the cover board to display the indication portion of the indication board.

The casing of the button system for industrial AC/DC relay of the present invention configured into a cover board and a housing, holes disposed in the middle portion of the cover board and cylinders corresponding to the holes are disposed in the housing, and the cover board is fixed with the housing by certain connection such as clamping, hot rivet or gluing. The edge of said cover board can have flange, and the casing having a corresponding recess, said flange of said cover board locked in the recess of said casing to enhance the connection intension to prevent the edge of the cover board from turning up.

The button of the button system for industrial AC/DC relay of the present invention installed in the casing by the following method: both sides of the opening of the cover board having a U-shaped groove respectively which opened downwardly, therefore, projections corresponding to the U-shaped groove are disposed on the housing to cooperated to limit and support the projection of the button, thus the button can rotate freely and reliably, i. e., the button can pivot on the projection freely.

The driving block of the button system for industrial AC/DC relay of the present invention slides within the guiding groove of the cover board, the sliding direction is parallel to the surface of the cover board, both sides of the driving arm has a U-shaped restoring arm respectively, when the button is in initial position, the end of the driving arm contacted the inner side of the toughing portion of the button, the toughing portion of the button driven the driving arm to slide along the groove, then the restoring arm is bent, when the button rotate return, the restoring arm driven the driving arm to restore.

The indicator board of the button system for industrial AC/DC relay of the present invention is driven by the driving block, when the upper portion of the vertical shaft of the indicator board pull by the driving arm of the driving block, the lower end of the vertical shaft of the indicator board will move to the reverse direction, the driving arm of the driving block only can drive the upper portion of the vertical shaft of the indicator board in one direction. The core propelling block has groove for containing the lower end of the vertical shaft of the indicator board, when the driving arm of the driving block pull the upper portion of the vertical shaft of the indicator board, the lower portion of the vertical shaft of the indicator board will move to the reverse direction to drive the core propelling block so that the close end of the contacting unit opened, and the opening end is closed to switch the load, and the indicator portion of the upper end of the indicator board (e.g. a red plastic sheet) move to the indication window of the cover board to show that the relay is in working status. When the driving arm of the driving block restored, the driving force on the indicator board removed, the core propelling block repositioned by the restoring force of the movable contact pieces, the groove of the core propelling block drive the lower portion of the indicator board to move back, the red plastic sheet on the upper end of the indicator board separate from the indicator window of the cover board to show the relay is restored.

The button system for industrial AC/DC relay of the present invention further provides an electric indicator device comprising LED for indicating the working status, in this electric indicator device, bi-directional LED can be used to fit AC/DC in the coil of the relay, the circuit of the LED connected to the coil of the relay in parallel, when the coil of the relay electrified by AC/DC, the LED is lighten to indicate the working status of the relay, and the light of the LED can be observed through the window on the cover board; when the bi-directional LED used in DC relay, one LED lighten and the other is transient voltage suppressed to suppress the surge current. when the bi-directional LED used in AC relay, the two LED can be lighten and protected to each other to ensure that the coil will not be breakdown by the surge current.

After the relay started, the driving block will be driven by the armature iron of the electromagnetic mechanism, and the lower portion of the vertical shaft of the indicator board will be driven by the groove of the driving block to rotate, the red plastic block on the upper end of the vertical shaft of the indicator board move to the indicator window of the cover board to show that the relay is started. The working status of the relay can be observed through two window disposed on the top of the cover board. One of the window is mechanism indication window, and the other is electric indication window.

Advantages: the button system of the present invention comprises a casing for containing the core of the relay, a button, a driving block, an indication board and a core propelling block, thus the button mechanism is a separate system and can be combined with the relay core with different specifications to provide products with various specification rapidly, accordingly, this lower the cost of the manufacture. The present invention only add the height of the relay, the installing area is the same as the core of the used relay, so the install method is the same as the core of the used relay. The casing configured to be a cover board and a housing, thus lower the difficult of manufacturing the part and enhance the strength and reliability of the structure. The present invention can be used in more recent AC/DC electromagnetic relays without change the install area of the relays, and can be installed compressed to match the lower-cost requirement for the machine tools and machines.

These and other features and advantages of the invention will become more readily apparent when reading the following description and claims in conjunction with the accompanying drawings.

DETAILED DESCRIPTION OF THE PREFERRED EMBODIMENTS

Embodiment 1

Figure 1:
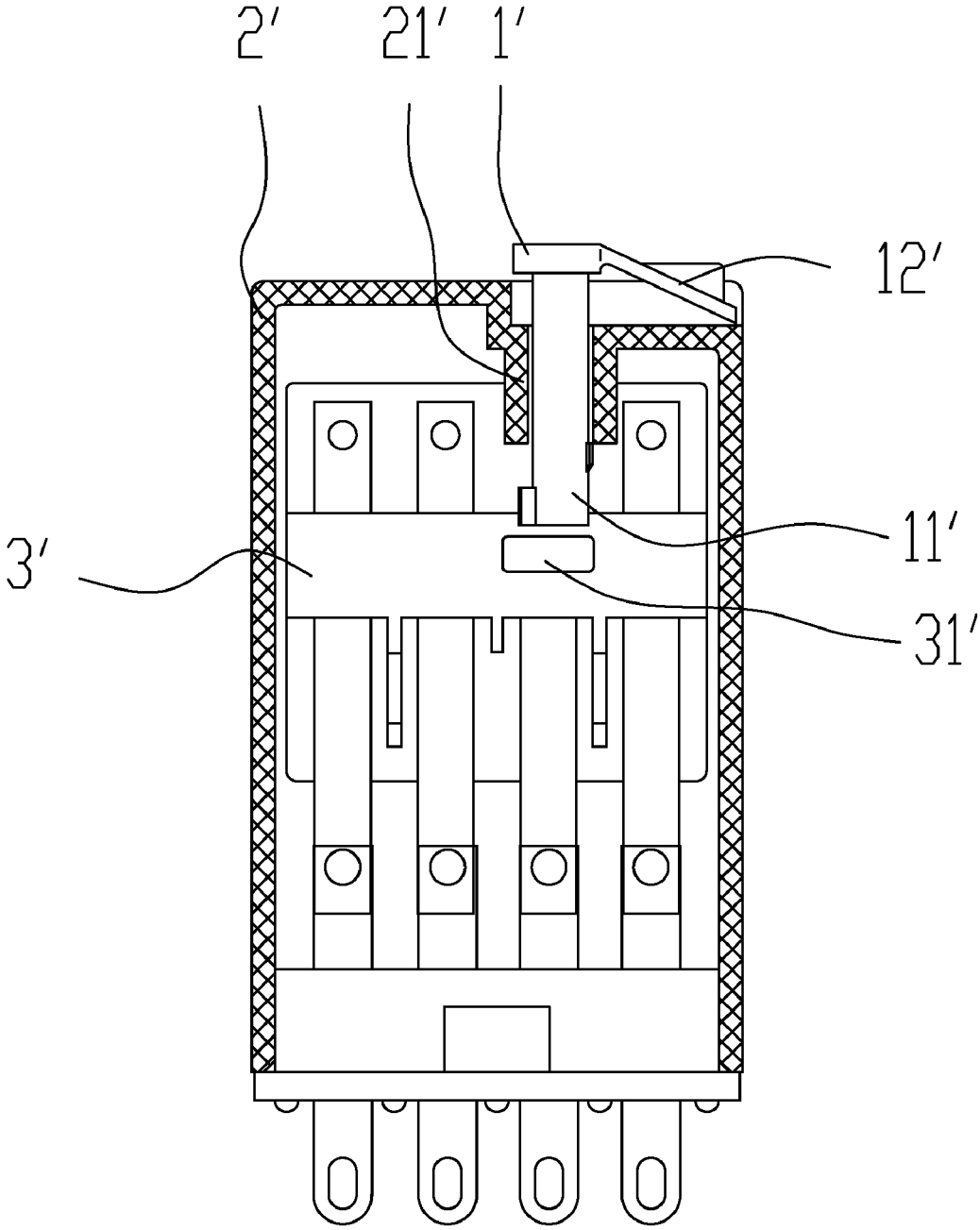
FIG. 1 is a sectional view of the button system of the button-type relay in prior art.
Figure 2:
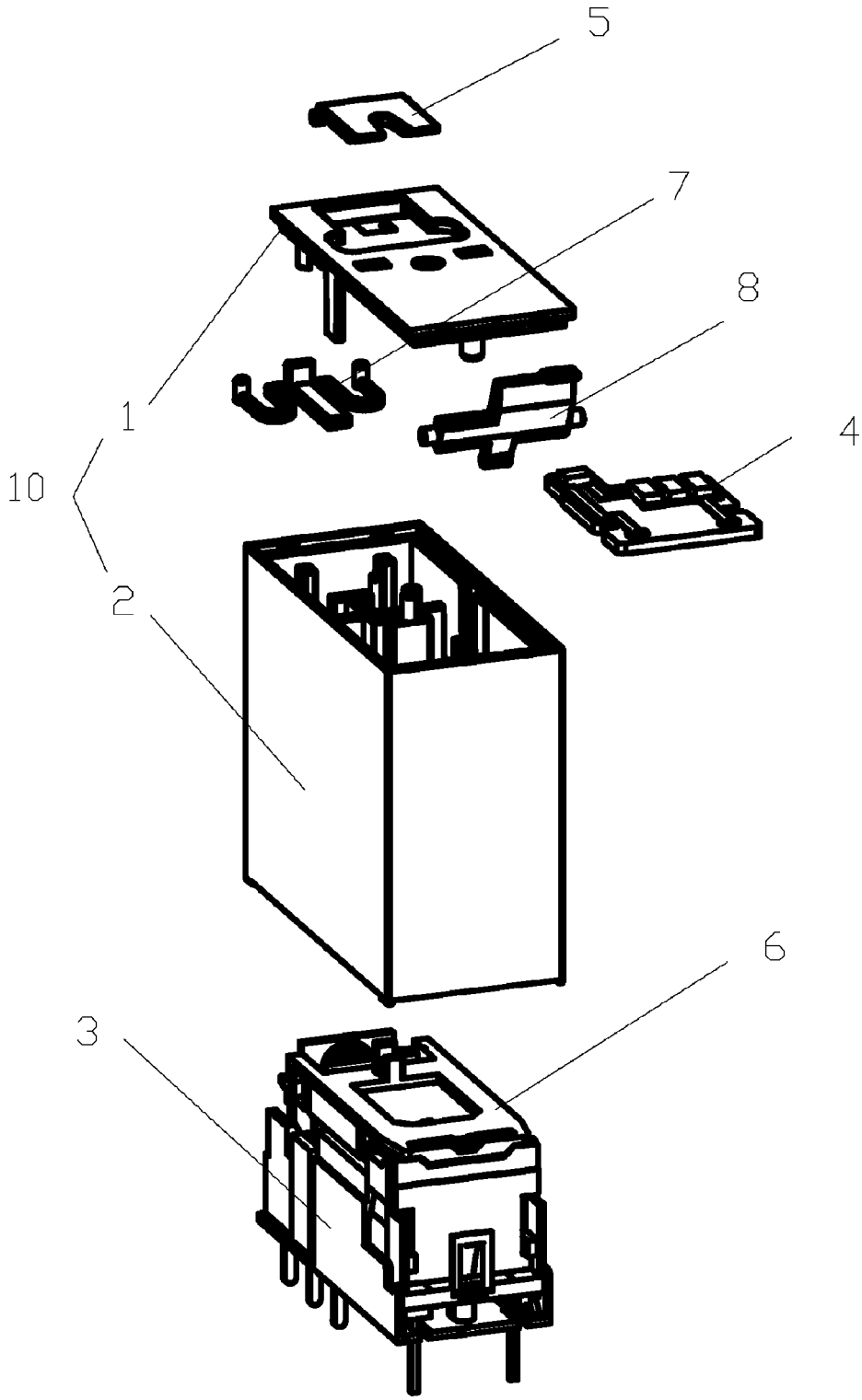
FIG. 2 is an exploded perspective view of the present invention in embodiment 1.
Figure 3:
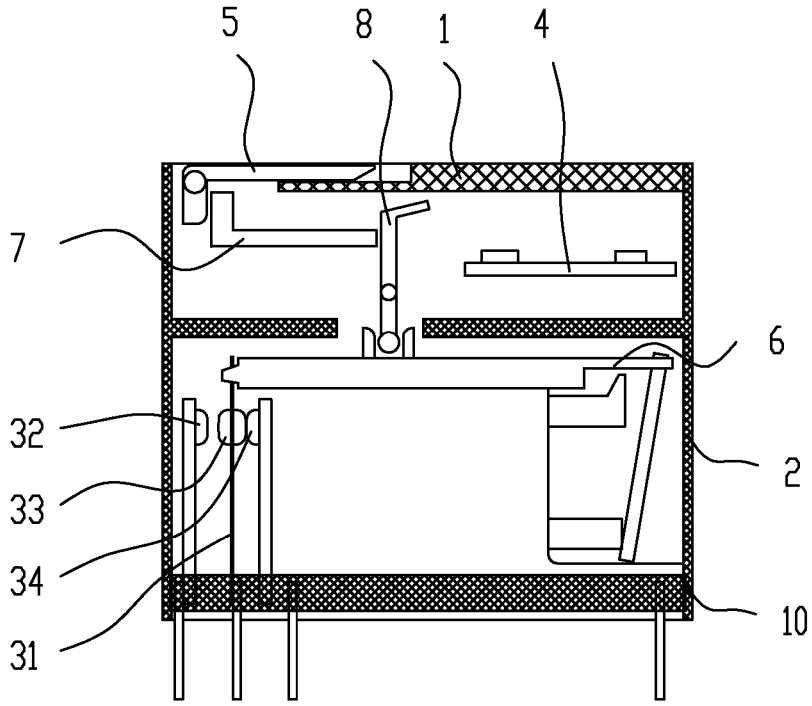
FIG. 3 is a sectional view of the present invention in embodiment 1.
Figure 4:
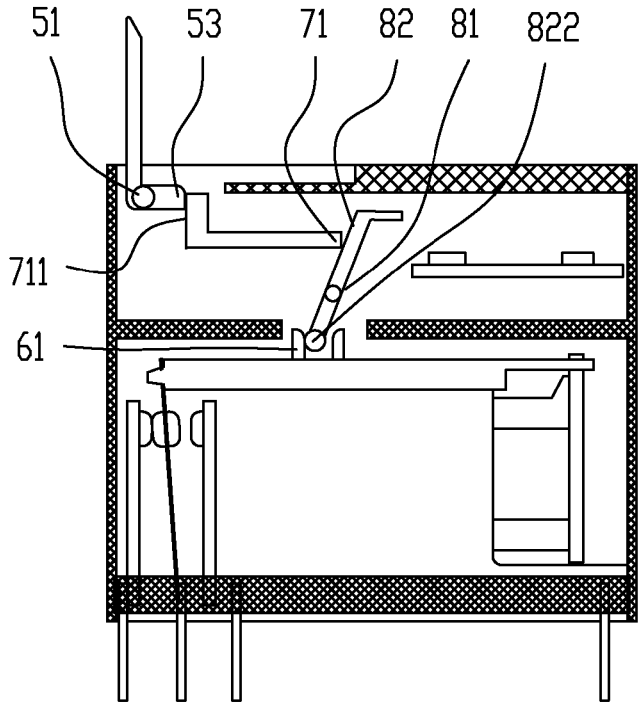
FIG. 4 is a sectional view of the present invention which illustrates the motion in embodiment 1.
Figure 5:
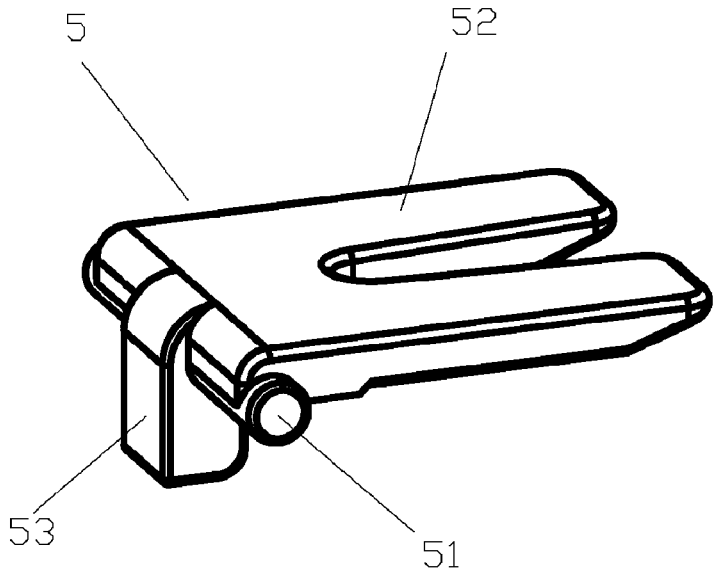
FIG. 5 is a perspective view of the button of the present invention in embodiment 1.

Referring to FIG. 2 to FIG. 10, a button system for industrial AC/DC relays of the present invention comprising:

A casing 10 for containing the core 3 of the relay, said casing 10 comprising a cover board 1, a housing 2, the cover board 1 and the housing 2 fixed together with each other, at least an opening 11 for pulling the button is arranged on the cover board 1; a PCB Mount 4 contained in the casing 10 also.

Figure 6:
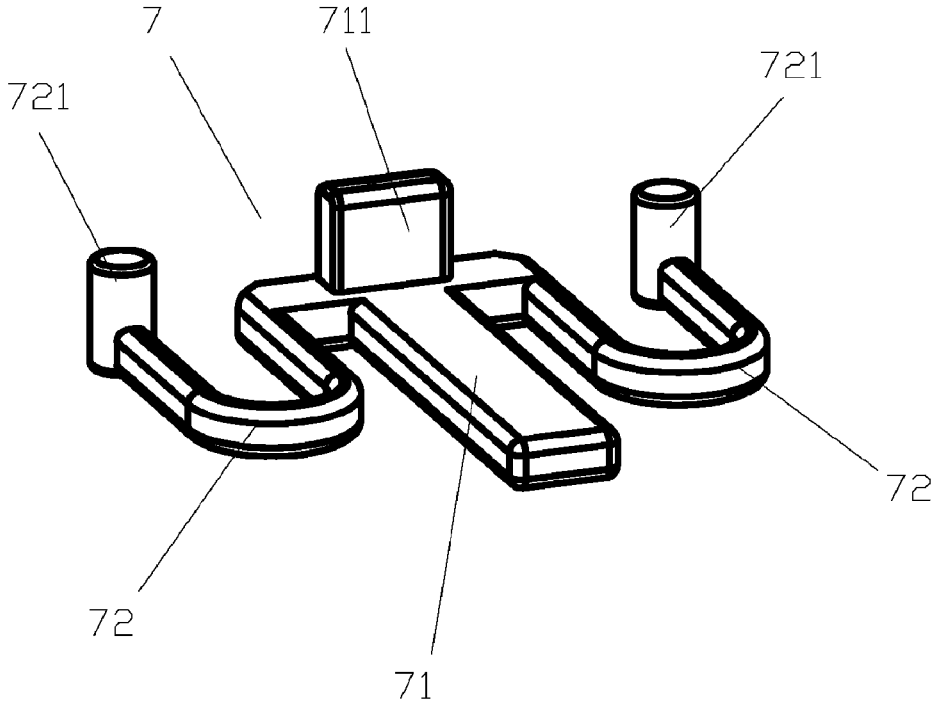
FIG. 6 is a perspective view of the driving block of the present invention in embodiment 1.
Figure 7:
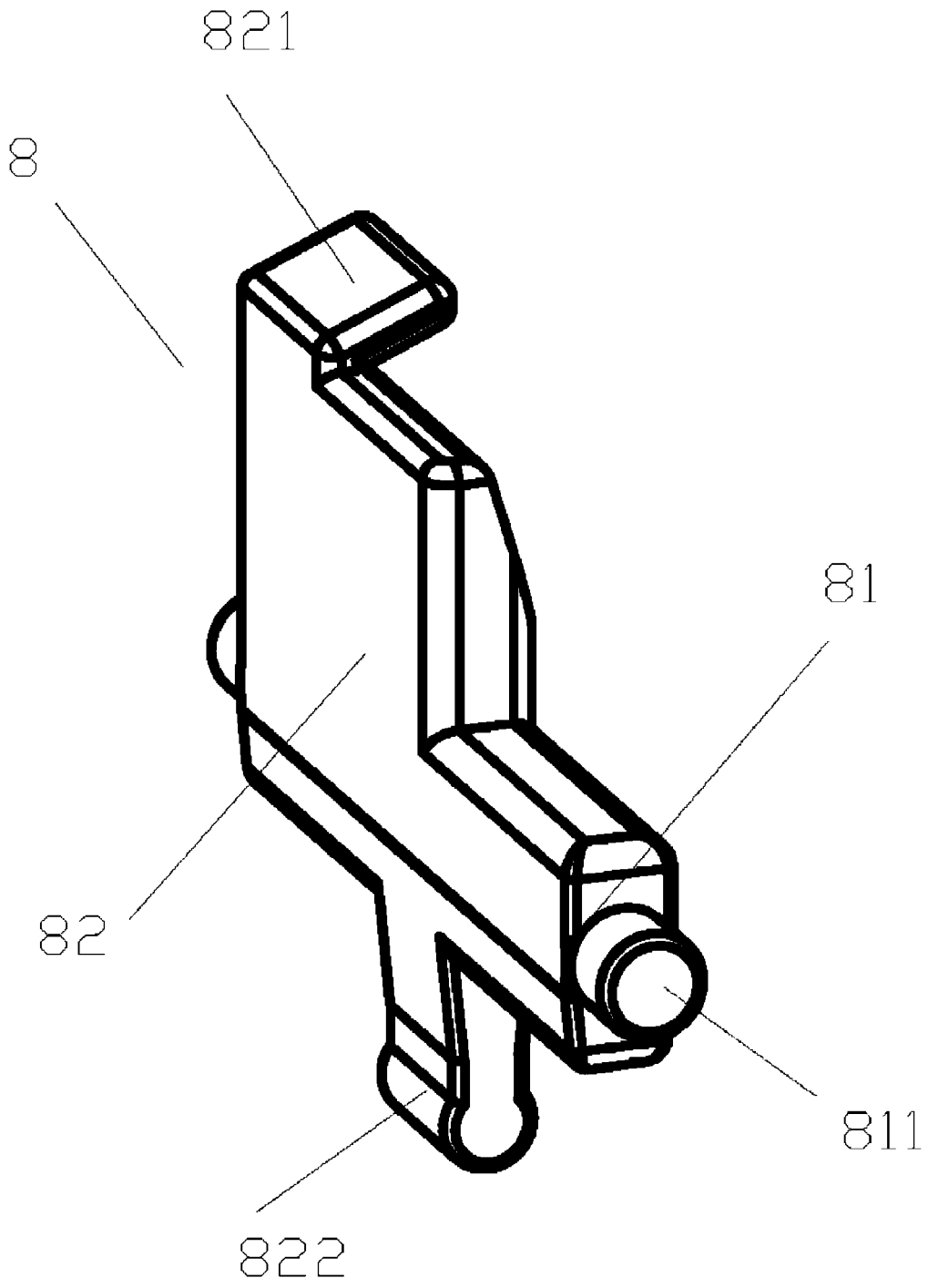
FIG. 7 is a perspective view of the indicator board of the present invention in embodiment 1.
Figure 8:
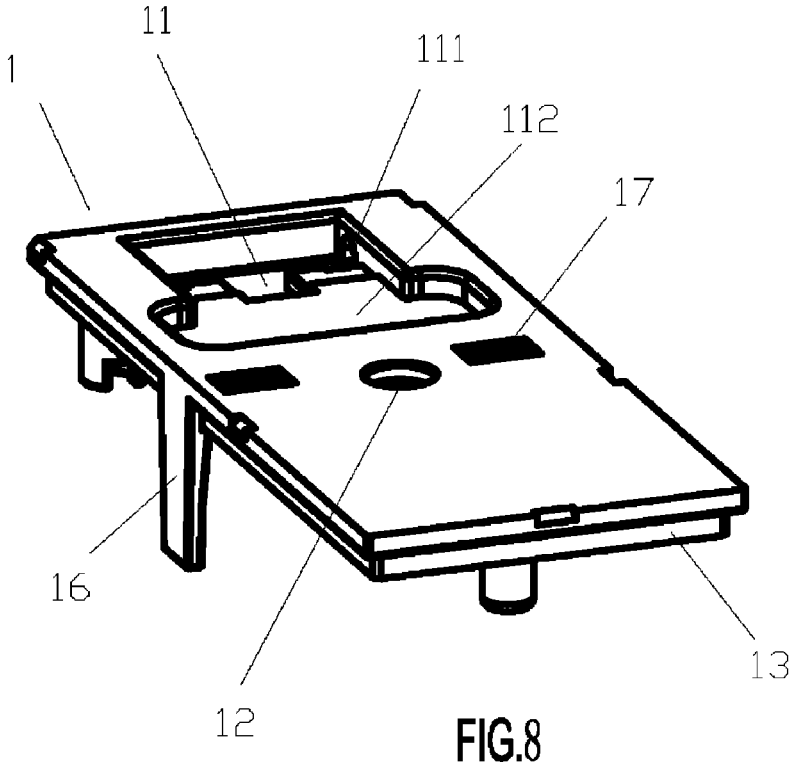
FIG. 8 is a perspective view of the cover board of the casing of the present invention in embodiment 1.
Figure 9:
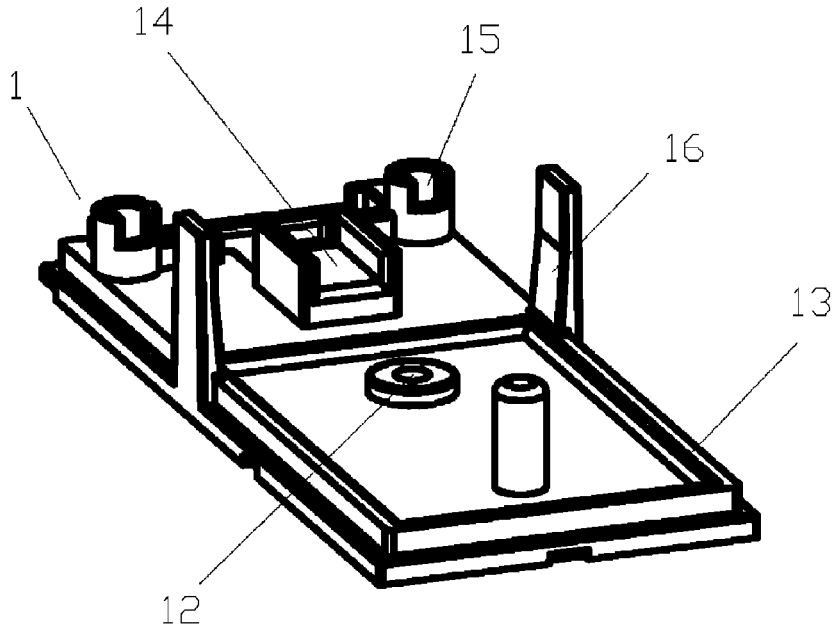
FIG. 9 is a perspective view of the cover board of the casing of the present invention in embodiment 1 (bottom up).
Figure 10:
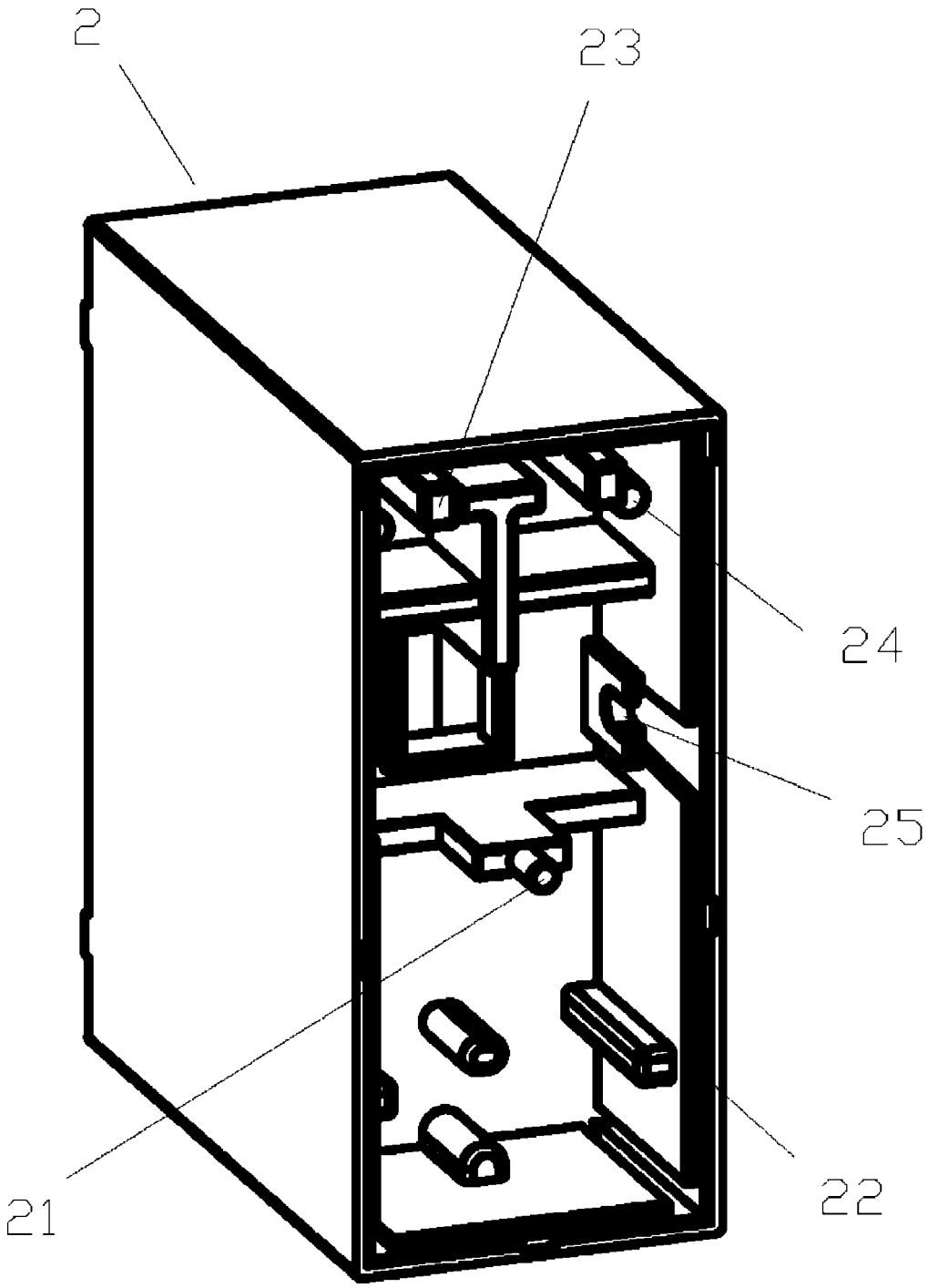
FIG. 10 is a perspective view of the housing of the casing of the present invention in embodiment 1 (standing at the side).
Figure 11:
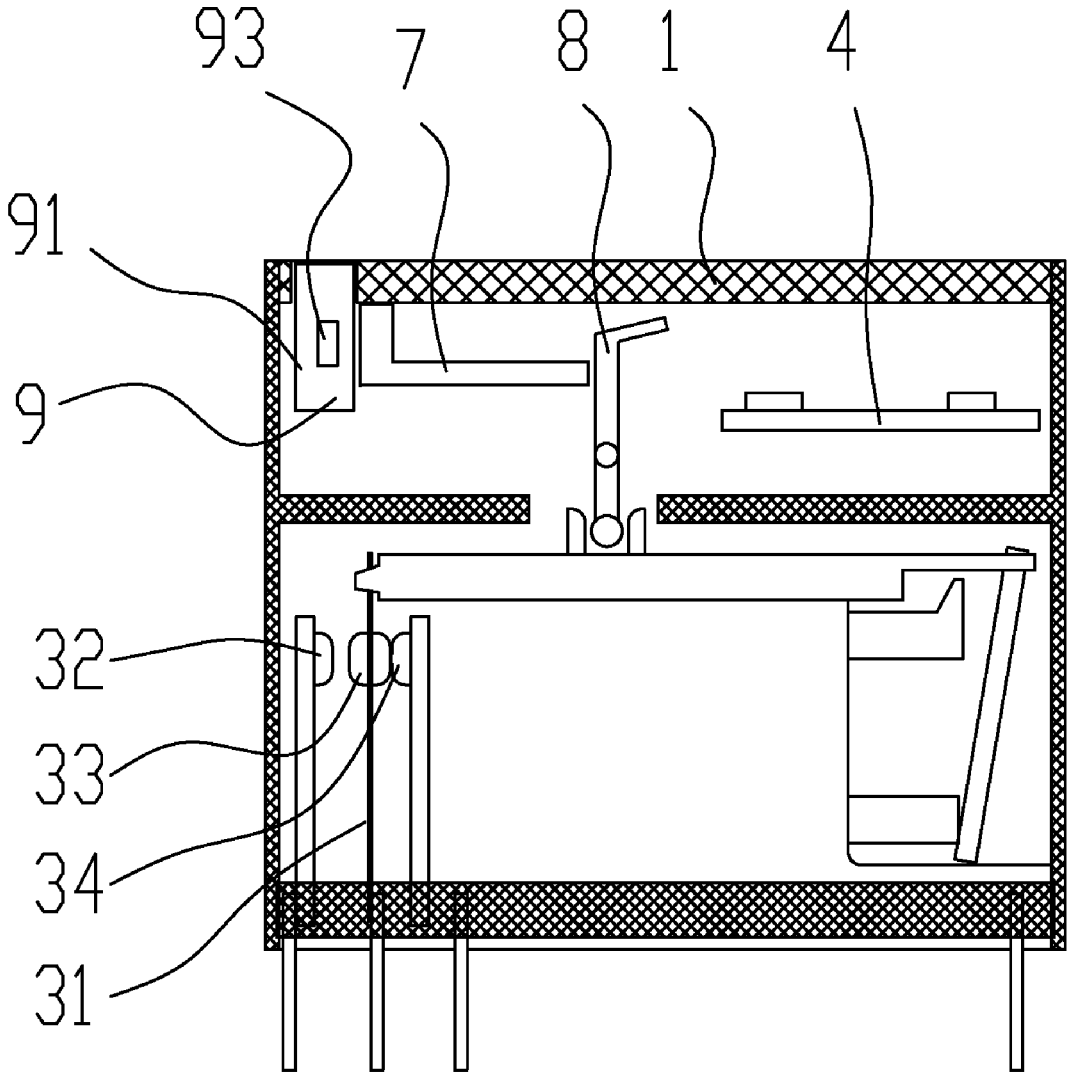
FIG. 11 is a sectional view of the present invention in embodiment 2.
Figure 12:
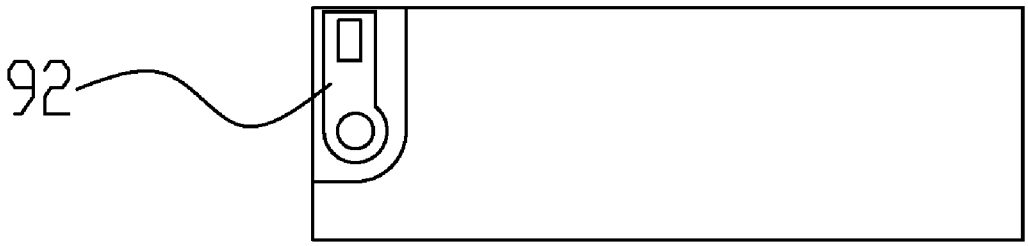
FIG. 12 is top view of the present invention in embodiment 2.
Figure 14:
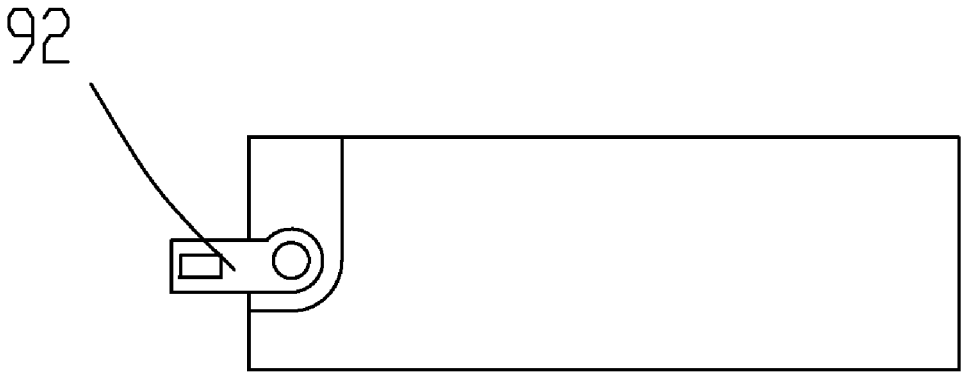
FIG. 14 is a top view of the present invention in embodiment 2 (illustrate the motion)
Figure 13:
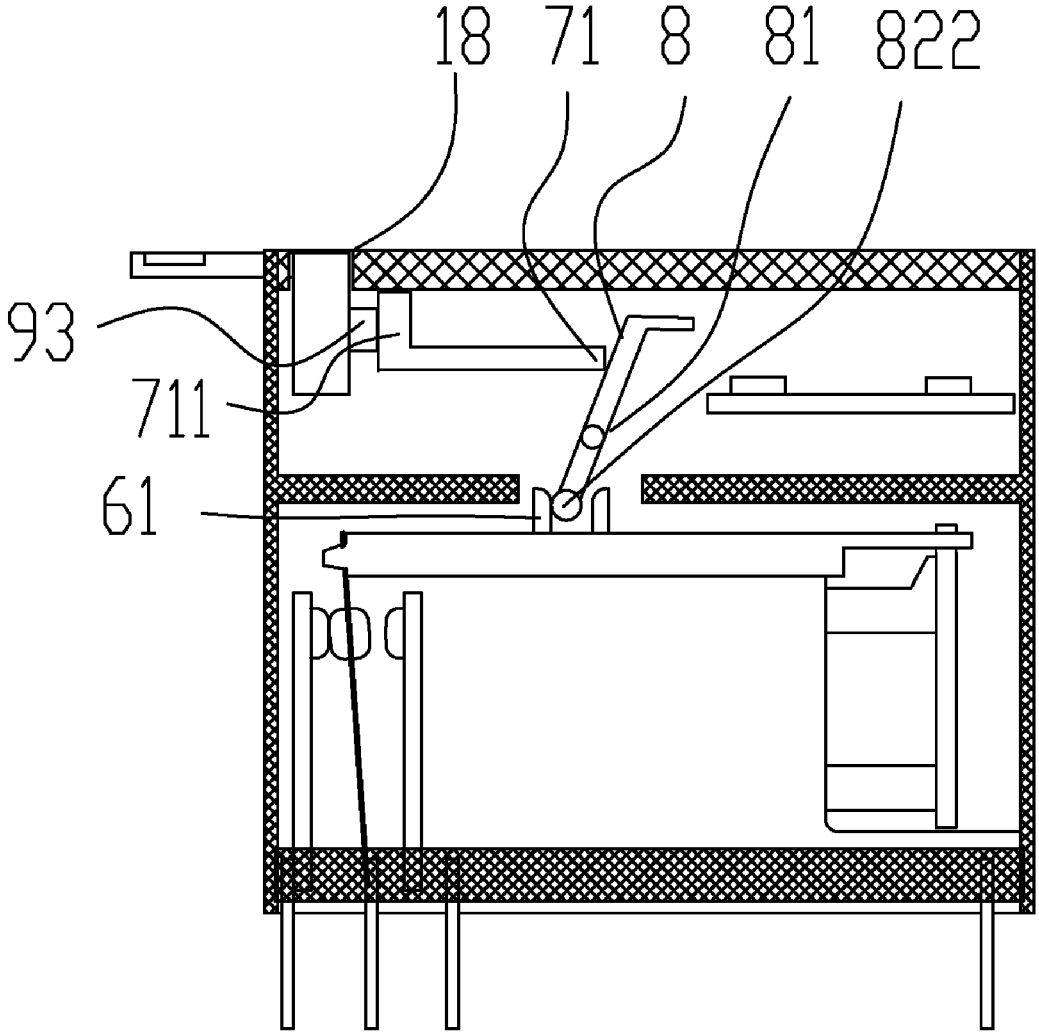
FIG. 13 is a sectional view of the present invention which illustrates the motion in embodiment 2.

A button 5 (referring to FIG. 5) pivoted on the upper portion of the casing 10 by a rotatable cross shaft 51, said button comprising a pulling portion 52 for being pull in the opening 11 of the casing 10 and a toughing portion 53 which can be rotated in the opening corresponding to the action of the pulling portion;

A driving block 7, referring to FIG. 6, installed in the casing 10, the end of the driving block abut against the toughing portion 53 of the button, the driving block 7 comprising a strip driving arm 71 which can be pulled by the rotation of the toughing portion of the button to move forwardly, a U-shaped restoring arm 72 incorporated with both sides of the end of the strip driving arm, the outer end of said restoring arm 72 is fixed to the casing 10;

An indicator board 8, referring to FIG. 7, having a rotatable cross shaft 81 in the middle portion, said indicator board pivoted in the casing 10 via said cross shaft 81, the upper portion of the indicator board abut against the front end of the strip driving arm 71 of the driving block, the lower portion matched with the core propelling block 6;

A core propelling block 6 horizontally mounted in the casing 10 and connected with the movable contact pieces 31 of the core 3 of the relay, the top of the core propelling block 6 having a groove 61, and the lower end 822 of the indicator board matched in the groove 61 of said core propelling block;

The cover board 1 having a hole 12, and the housing 2 having a corresponding cylinder 21, the cylinder 21 of casing clamped in the hole 12 of cover board 1, and the cover board 1 fixed with the housing 2 by clamping or hot rivet or gluing. The edge of said cover board 1 having flange 13, and the housing 2 having corresponding recess 22, said flange 13 of said cover board locked in the recess 12 of said casing. The pulling portion 52 of said button is board structure, both sides of the end of the board structure has a cylindrical projection 51 pivotally connected to the casing 10 respectively, the toughing portion 53 is a protrusion structure vertical to the board structure, the protrusion structure arranged in the middle of the end of the board structure.

Both sides of the opening 11 of the cover board 1 has a U-shaped groove 111 opened downwardly respectively, the two protrusion cylinders 51 rotatably contained in the two U-shape grooves 111 of the cover board, and the protrusion cylinders 23 are limit and supported by the corresponding portion of said housing 2. A container 112 for supporting the pulling portion 52 of the button is disposed on the opening 11 of the cover board 1.

The inner side of said cover board having a guiding groove 14 parallel to the board surface, the strip driving arm 71 of the driving block slidably mounted in the guiding groove 14 of said cover board. A bend portion 711 abut against the toughing portion 53 of the button is arranged on the rear end of the strip driving arm 71.

The outer end of the U-shaped restoring arm 72 of said driving block having a protrusion 721, the inner side of the cover board 1 having a recess 15 for fixing the protrusion 721, the protrusion 721 of the outer end of the U-shaped restoring arm 72 inserted in the recess 15 of said cover board 1;

The housing 2 has a projection 24 to correspond to the recess 15 in the cover board for fixing the U-shaped restoring arm, the projection 24 abut against the bottom of the protrusion 721 of the U-shaped restoring arm.

The indicator board has a cross structure comprising a transverse shaft 81 and a vertical shaft 82, both ends of the transverse shaft 81 has a projection 811 respectively, the two corresponding walls of the housing 2 has a U-shaped groove 25, and the two projection 811 of the indicator board can be rotate freely within the two U-shaped grooves 25 of the housing and limit by the two projections 16 protruded downwardly from the corresponding portion of the cover board 1.

The upper end of the vertical shaft 82 of said indicator board has a indication portion 821 for indicating the motion of the relay, and a indication window 17 disposed on the cover board 1 to display the indication portion of the indication board.

The casing 10 of the button system for industrial AC/DC relay of the present invention configured to be a cover board 1 and a housing 2, a hole is disposed in the middle portion of the cover board 1 and a cylinder 21 corresponding to the holes is disposed in the housing 2, and the cover board 1 is fixed with the housing 2 by certain connection such as clamping, hot rivet or gluing. The edge of said cover board formed a flange 13, and the housing 2 formed a corresponding recess 22, said flange of said cover board locked in the recess of said casing to enhance the connection intension to prevent the edge of the cover board 1 from turning up.

The button 5 of the button system for industrial AC/DC relay of the present invention installed in the housing by the following way: both sides of the opening 11 of the cover board has a U-shaped groove 111 opened downwardly respectively, therefore, projections 23 corresponding to the U-shaped grooves 111 are arranged on the housing 2 to cooperated with the U-shaped grooves to limit and support the projections 51 of the button, thus the button can rotate freely and reliably, i.e., the button 5 can pivot on the projection 51.

The driving block 7 of the button system for industrial AC/DC relay of the present invention is slide within the guiding groove 14 of the cover board 1, the sliding direction is parallel to the surface of cover board 1, both sides of the driving arm 71 has a U-shaped restoring arm 72 respectively, when the button 5 is in initial position, the end of the driving arm 71 contact the inner side of the toughing portion 53 of the button, when the button 5 rotated, the toughing portion 53 of the button driving the driving arm 71 to slide along the groove 14, then the restoring arm 72 is bent, when the button 5 rotated back, the restoring arm 72 drive the driving arm 71 to restore position.

The indicator board of the button system for industrial AC/DC relay of the present invention is driven by the driving block, when the driving arm 71 of the driving block pull the upper portion of the vertical shaft 82 of the indicator board 8, the lower portion 822 of the vertical shaft of the indicator board will move to the reverse direction, the driving arm of the driving block only can drive the upper portion of the vertical shaft of the indicator board in one direction. The core propelling block 6 has a groove 61 for containing the lower portion 822 of the vertical shaft of the indicator board, when the driving arm 71 of the driving block pull the upper end 82 of the vertical shaft of the indicator board, the lower end of the vertical shaft of the indicator board 8 will move to the reverse direction to drive the core propelling block 6 so that the close end of the contacting unit opened, and the opening end is closed to switch the load, and the indicator portion 821 (e. g. a red plastic sheet) of the upper end of the indicator board move to the indication window 17 of the cover board to show the operation of the relay. When the driving arm 71 of the driving block reposition, the driving force on the indicator board 8 removed, the core propelling block 6 repositioned by the restoring force of the movable contact pieces 31, the groove 61 of the core propelling block drive the lower end 822 of the indicator board 8 to move back, the red plastic sheet 821 on the upper end of the indicator board separate from the indicator window 17 of the cover board to show the relay is restored.

The button system for industrial AC/DC relay of the present invention further provides an electric indicator device comprising LED for indicating the working status, in this electric indicator device, bi-directional LED can be used to fit AC/DC in the coil of the relay, the circuit of the LED connected to the coil of the relay in parallel, when the coil of the relay electrified by AC/DC, the LED is lighten to indicate the working status of the relay, and the light of the LED can be observed through the window on the cover board; when the bi-directional LED used in DC relay, one LED lighten and the other is transient voltage suppressed to suppress the surge current. When the bi-directional LED used in AC relay, the two LED can be lighten and protected to each other to ensure that the coil will not be breakdown by the surge current.

When the button 5 pivoted on the shaft 51, driven by the toughing portion 53 of the button, the bending portion 711 of the driving block 7 will move, thus the front end of the driving arm 71 of the driving block 7 abut against the upper portion of the indicator board 8, therefore, the indicator board 8 pivot on the shaft 81, the lower end 822 of the indicator board 8 drive the groove 61 of the core propelling block 6 to urge the core propelling block move forwardly, thus the contacting switching of the relay is achieved (the contacting between the contact 32 and contact 33 is from cut-off status to connecting status, and the contacting between the contact 33 and contact 34 is from connecting status to cut-off status).

When the rotate angle of button 5 reach 90°, the toughing portion 53 of the button is cooperated with the surface of the bending portion 711 of the driving block and locked, thus the driving system is maintained in a locked status stably.

When the button 5 is return to 0° from 90°, the bending portion 711 of the driving 7 is not limited by the toughing 53 of the button 5, then the driving block 7 will be repositioned by the restoring arm 72, after the driving block 7 repositioned, the front end of the driving arm 7 will not act on the upper portion of the indicator board 8. The lower portion 822 of the indicator board 8 will be repositioned by the indicator board 8 driven by the groove 61 of the core propelling block 6 by the movable contact pieces 31, the contact of the relay repositioned (the contacting between the contact 32 and contact 33 is from connecting status to cut-off status, and the contacting between the contact 33 and contact 34 is from cut-off status to connecting status).

The lower portion of the indicator board 8 inserted into the groove 61 of the core propelling block 6, if the indicator board 8 rotated (clockwise) by the driving block 7, the lower portion 822 will drive the core propelling block 6 by the side of the lower portion 822. when the driving block does not act on the indicator board 8, the core propelling block 6 will repositioned by the movable contact pieces 31, the groove 61 will drive the lower portion 822 of the indicator board 8 to move anti-clockwise.

Embodiment 2

Referring to FIG. 11 to FIG. 14, a button system for industrial AC/DC relays of the present invention comprises a button 9, a cover board 1, a driving block 7, a indicator board 8, a core propelling block 6 and a housing 2, the difference to the embodiment 1 is that: the button 9 consisted of a cylinder 91 and a spanner 92, the cylinder 91 can rotate within the hole 18 of the cover board 1, after the button 9 rotated, the protrusion 93 of the cylinder will drive the bending portion 711 of the driving block 7, thus the driving block 7 moved. In the moving action, the front end of the driving arm 71 of the driving block 7 abut against the upper portion of the indicator board 8, so that the indicator board 8 rotated about the shaft 81, the lower portion 822 of the indicator board 8 drive the groove 61 of the core propelling block 6 to move, thus the contact of the relay switched (the contacting between the contact 32 and contact 33 is from cut-off status to connecting status, and the contacting between the contact 33 and contact 34 is from connecting status to cut-off status).

When the rotate angle of button 5 reach 90°, the toughing portion 53 of the button is cooperated with the surface of the bending portion 711 of the driving block and locked, thus the driving system is maintained in a locked status stably.

When the button 5 is return to 0° from 90°, the bending portion 711 of the driving 7 is not limited by the toughing 53 of the button 5, then the driving block 7 will be repositioned by the restoring arm 72, after the driving block 7 repositioned, the front end of the driving arm 7 will not act on the upper portion of the indicator board 8. the lower portion 822 of the indicator board 8 will be repositioned by the indicator board 8 driven by the groove 61 of the core propelling block 6 by the movable contact pieces 31, the contact repositioned (the contacting between the contact 32 and contact 33 is from connecting status to cut-off status, and the contacting between the contact 33 and contact 34 is from cut-off status to connecting status).

INDUSTRIAL APPLICABILITY

The button system for industrial AC/DC relays of the present invention and can be combined with the relay core with different specifications to provide products with various specification rapidly, thus lower the cost of the manufacture. The casing being divided into a cover board and a housing lower the difficult of manufacturing the part and enhance the strength and reliability of the structure.

It will be understood that the description above is of the preferred exemplary embodiment of the invention and that the invention is not limited to the specific forms shown and described. Other substitutions, modifications, changes and omissions may be made in the design and arrangement of the preferred embodiment without departing from the spirit of the invention as expressed in the appended claims.

What is claimed is:

1. A button system for industrial AC/DC relays comprising:

a casing for containing the core of the relay, said casing comprising a cover board, a housing, wherein the cover board and the housing fixed with each other, and at least an opening for pulling the button is arranged on the cover board;

said button pivoted on upper portion of the casing by a rotatable cross shaft, said button comprising a pulling portion which can be pull in the opening of the casing and a toughing portion which can be rotated in the opening according to the action of the pulling portion;

a driving block installed in the casing, the end of the driving block abut against the toughing portion of the button, the driving block comprising a strip driving arm which can be pushed to move forwardly by the rotation of the toughing portion of the button, and two U-shaped restoring arms incorporated on both sides of the end of the strip driving arm, the outer end of said restoring arms fixed to the casing;

an indicator board having rotatable cross shafts in the middle portion, said indicator board pivoted in the casing via said cross shafts, the upper portion of the indicator board abut against the front end of the strip driving arm of the driving block, and the lower portion cooperated with a core propelling block;

the core propelling block horizontally mounted in the casing and connected with the movable contact pieces of the core of the relay, a groove disposed on the top of the core propelling block, and the lower end of the indicator board matched in the groove of said core propelling block.

2. The button system for industrial AC/DC relays according to claim 1, wherein said cover board having a hole, and the casing having a corresponding projection, the projection of the casing inserted in the hole of cover board, and the cover board fixed with the casing by clamping or hot rivet or gluing.

3. The button system for industrial AC/DC relays according to claim 2, wherein the edges of said cover board formed a flange, and the casing formed a recess in corresponding position, said flange of said cover board locked in the recess of said casing.

4. The button system for industrial AC/DC relays according to claim 1, wherein the pulling portion of said button is board shape, cylindrical projections projecting in opposed direction at the end on both sides of the board, cylindrical projections pivotally connected to the casing, the toughing portion of said button is a protrusion vertical to the board, the protrusion arranged in the middle of the end of the board structure.

5. The button system for industrial AC/DC relays according to claim 4, wherein both sides of the opening of the cover board has a U-shaped groove respectively which opened downwardly, the two cylindrical projections rotatably contained in the two U-shape grooves of the cover board, and the cylindrical projections are limit and supported by the corresponding portion of said casing.

6. The button system for industrial AC/DC relays according to claim 1, wherein the inner side of said cover board having a guiding groove parallel to the board surface, the strip driving arm of the driving block slidably mounted in the guiding groove of said cover board.

7. The button system for industrial AC/DC relays according to claim 1, wherein the outer end of the U-shaped restoring arm of said driving block having a protrusion, and a recess for fixing the protrusion disposed the inner side of the cover board, the protrusion of the outer end of the U-shaped restoring arm inserted in the recess of said cover board.

8. The button system for industrial AC/DC relays according to claim 7, wherein a projection abut against the bottom of the protrusion of the U-shaped restoring arm is arranged in said housing in the position corresponding to the recess of said cover board for fixing the U-shaped restoring arm.

9. The button system for industrial AC/DC relays according to claim 1, wherein said indicator board has a cross structure comprising a transverse shaft and a vertical shaft, both ends of the transverse shaft having a projection respectively, and the two corresponding wall of the casing having a U-shaped groove respectively; the two projection rotatably contained in the two U-shaped grooves of the housing and are limit by a corresponding portion of the cover board.

10. The button system for industrial AC/DC relays according to claim 9, wherein the upper end of the vertical shaft of said indicator board has a indication portion for indicating the motion of the relay, and a indication window disposed on the cover board to display the indication portion of the indication board.

11. A button system for industrial AC/DC relays comprising:

a casing for containing the core of the relay, said casing comprising a cover board, a housing, the cover board and the housing fixed with each other, at least an opening for pulling the button is arranged on the cover board;

a button comprising a cylinder and a spanner, said cylinder can rotate within the hole of the cover board and a projection formed on the cylinder;

a driving block installed in the casing, the end of the driving block abut against the projection of the button, the driving block comprising a strip driving arm which can be pushed to move forwardly by the rotation of the projection of the button, and two U-shaped restoring arms incorporated on both sides of the end of the strip driving arm, the outer end of said restoring arms fixed to the casing;

an indicator board having rotatable cross shafts in the middle portion, said indicator board pivoted in the casing via said cross shafts, the upper portion of the indicator board abut against the front end of the strip driving arm of the driving block, and the lower portion cooperated with the core propelling block;

a core propelling block horizontally mounted in the casing and connected with the movable contact pieces of the core of the relay, a groove disposed on the top of the core propelling block, and lower end of the indicator board matched in the groove of said core propelling block.

12. The button system for industrial AC/DC relays according to claim 11, wherein the inner side of said cover board having a guiding groove parallel to the board surface, the strip driving arm of the driving block slidably mounted in the guiding groove of said cover board.

13. The button system for industrial AC/DC relays according to claim 11, wherein the outer end of the U-shaped restoring arm of said driving block having a protrusion, and a recess for fixing the protrusion disposed the inner side of the cover board, the protrusion of the outer end of the U-shaped restoring arm inserted in the recess of said cover board.

14. The button system for industrial AC/DC relays according to claim 13, wherein a projection abut against the bottom of the protrusion of the U-shaped restoring arm is arranged in said housing in the position corresponding to the recess of said cover board for fixing the U-shaped restoring arm.

* * * * *